US010059884B2

(12) United States Patent
Gaillet et al.

(10) Patent No.: US 10,059,884 B2
(45) Date of Patent: Aug. 28, 2018

(54) COKING PLANT AND METHOD FOR CONTROLLING SAID PLANT

(75) Inventors: Jean-Paul Gaillet, Petit-Ebersviller (FR); Daniel Isler, Folschviller (FR); Etienne Petit, Fey (FR); Juliette Delinchant, Elvanche (FR)

(73) Assignee: ARCELORMITTAL MAIZIERES RESEARCH SA, Saint-Denis (FR)

( * ) Notice: Subject to any disclaimer, the term of this patent is extended or adjusted under 35 U.S.C. 154(b) by 621 days.

(21) Appl. No.: 13/878,092

(22) PCT Filed: Oct. 5, 2011

(86) PCT No.: PCT/FR2011/000541

§ 371 (c)(1),
(2), (4) Date: Apr. 5, 2013

(87) PCT Pub. No.: WO2012/045926

PCT Pub. Date: Apr. 12, 2012

(65) Prior Publication Data

US 2013/0213791 A1 Aug. 22, 2013

(30) Foreign Application Priority Data

Oct. 5, 2010 (WO) ..... PCT/FR2010/000663

(51) Int. Cl.

| | |
|---|---|
| ***C10B 27/00*** | (2006.01) |
| ***C10B 27/06*** | (2006.01) |
| ***C10B 41/08*** | (2006.01) |

(52) U.S. Cl.

CPC ..... *C10B 27/06* (2013.01); *C10B 41/08* (2013.01); *C10B 27/00* (2013.01)

(58) Field of Classification Search

CPC ..... C10B 41/08; C10B 27/00; C10B 27/02; C10B 27/04; C10B 27/06

See application file for complete search history.

(56) References Cited

U.S. PATENT DOCUMENTS

| | | | | |
|---|---|---|---|---|
| 1,747,610 | A | 2/1930 | Ackeren | |
| 1,844,889 | A | 2/1932 | Miller | |
| 3,647,053 | A * | 3/1972 | Palumbo | 201/1 |

(Continued)

FOREIGN PATENT DOCUMENTS

| | | |
|---|---|---|
| CN | 101429439 A | 5/2009 |
| DE | 950 318 | 10/1956 |

(Continued)

*Primary Examiner* — In Suk C Bullock
*Assistant Examiner* — Jonathan L Pilcher
(74) *Attorney, Agent, or Firm* — Davidson, Davidson & Kappel, LLC

(57) ABSTRACT

The present invention provides a coking plant. The coking plant includes a series of coke ovens, each oven including a coking chamber provided with side unloading doors. The chamber communicates with a riser provided with a coking-gas discharge pipe. The discharge pipes of each oven lead into a collecting cylinder, which is in turn connected to a coking gas treatment circuit. At least one discharge pipe of one of the ovens further includes a device for spraying pressurized liquid onto the wall of the discharge pipe. The liquid flows counter-current with respect to the direction of the flow of the gases exiting the chamber. The present invention also provides a method for controlling such a plant.

25 Claims, 2 Drawing Sheets

(56) References Cited

U.S. PATENT DOCUMENTS

| | | | | |
|---|---|---|---|---|
| 4,231,845 | A * | 11/1980 | Vander et al. | 202/113 |
| 4,456,175 | A * | 6/1984 | Mamrosov et al. | 239/113 |
| 5,609,731 | A * | 3/1997 | Giertz et al. | 201/35 |
| 8,491,757 | B2 | 7/2013 | Lonardi | |

FOREIGN PATENT DOCUMENTS

| | | | | |
|---|---|---|---|---|
| FR | 646 858 | | 11/1928 | |
| GB | 29125 | | 12/1910 | |
| GB | 371282 | | 4/1932 | |
| GB | 371282 | A * | 4/1932 | C10B 27/06 |
| JP | 58-38785 | | 3/1983 | |
| JP | 9-310072 | | 12/1997 | |
| JP | H09310072 | | 12/1997 | |
| JP | 2000-198986 | | 7/2000 | |
| JP | 2001-152157 | | 6/2001 | |
| JP | 2001152157 | | 6/2001 | |
| KR | 200355147 | | 7/2004 | |
| KR | 20100020483 | | 2/2010 | |
| WO | 02/094966 | A1 | 11/2002 | |

* cited by examiner

COKING PLANT AND METHOD FOR CONTROLLING SAID PLANT

The present invention relates to a coking plant comprising ovens that produce coke from coal, in order to supply steelmaking blast furnaces in reducing agent in iron producing reactors, as well as a process for managing such an installation.

BACKGROUND

Coal is transformed into coke when it is baked in the absence of air in refractory ovens arranged in batteries. The transformation process releases a large volume of hot gases (approximately 700-750° C.) at the beginning of the baking phase that gradually decreases as the process advances.

In each oven, these gases are discharged through a riser pipe closed by a valve at the top. Each riser pipe opens, via a bent discharge pipe, into a barrel, which is a large-diameter pipe that collects the gases from the oven battery and routes them to a treatment circuit. Each bent discharge pipe comprises an ammonia water nozzle to cool the gases to about 80° C. before they enter the barrel and a sealing plate (or plate), located at the intersection with the barrel, and which can take two positions. In the open position, the plate is vertical, leaving the passage entirely free for the gases. In the closed position, the plate is horizontal, enabling to completely stop the passage of the gases towards the barrel.

During the coking phase, the riser pipe valve of each oven is closed, enabling the evacuation of gases to the barrel. The sealing plates of the ovens are in the open position at this time.

When coking is completed and the coke is unloaded out of the oven, the valve is opened and the oven plate is closed, which enables to isolate the barrel and to evacuate the residual gases through the riser pipe.

In most coking plants, only the pressure on the barrel is regulated around a set point that varies between 70 and 150 Pa depending on the height of the ovens. At the beginning of the baking phase, the high gas pressures in the ovens result in the emission of gas through the oven doors, despite the care taken in their maintenance and their leakproofness. These emissions, which comprise fine particulates, carbon monoxide and polycyclic aromatic hydrocarbons (PAH) have a significant impact on working conditions and the quality of ambient air.

At the end of baking, the ovens may be under negative pressure and air from the outside may be let in, eventually resulting in the deterioration of the refractory bricks due to combustion close to the oven entrances.

Some coking plants that give priority to the life cycle of ovens work with a high barrel pressure to maintain positive pressure in ovens at the end of the baking, even if this creates emissions at the doors. Other coking plants, which are subject to very stringent environmental requirements, such as the United States with the Clean Air Act, operate at very low barrel pressures, at the risk of deteriorating the oven entrances and adversely impacting the oven life cycle.

To reduce smoke emissions during loading, there is a first type of coking plant wherein the ammonia water nozzle placed in the bent discharge pipe projects pressurized water (30 to 40 bars) in the direction of the flow of gases, thus creating a suction effect of these gases to the treatment circuit. This nozzle operates at high pressure for only two minutes when the coal is loaded into the ovens and during the five minutes following this loading, whereas baking lasts between 16 and 20 hours. If a high barrel pressure is maintained, this technology does not enable emissions to be eliminated during the first hours of baking of the ovens.

To improve the management of these gas emissions, there is a second type of coking plant in which the pressure in each oven can be controlled separately. It is described in particular in WO 02/094966. This plant comprises a bent discharge pipe extended inside the barrel by a straight pipe with crenel cutouts through which the gases pass. This pipe leads to a dome filled with water in the manner of a siphon, the dome being connected to a pneumatic cylinder that is used to adjust the height of the dome and hence the surface of passage of the gases. The pneumatic cylinder is controlled depending on the pressure measurements taken inside the oven, and the barrel is maintained under suction throughout the oven baking cycle. This system allows the oven pressure to be regulated efficiently and, in particular, to maintain a slight positive pressure at the end of baking.

However, it has the disadvantage of being mechanically complex, thus requiring significant maintenance. It also requires a substantial modification of existing facilities. Lastly, all the equipment must be doubled for safety reasons and its use does not prevent gas leakage at the oven doors when coking begins.

There is also a last type of coking plant where the pressure in each oven can be controlled separately. This system consists in changing the first type of plants by articulating and controlling the position of the oven plate, so it can take all the possible intermediate positions between the open vertical position and the closed horizontal position. It is thus possible to regulate the pressure in each oven by partially closing the plate according to the pressure measured at the bottom of each riser pipe. The plate is also modified to take the form of a bell on its upper part, in order to optimize the system sensitivity, especially when it is closed completely. However, this system has some disadvantages in practice, because it is very sensitive to the slightest change in pressure and requires fine control, which is difficult to implement.

SUMMARY OF THE INVENTION

An object of the present invention is to provide a coking plant and a controlling method of such a plant allowing reducing coking gas emissions without shortening the life cycle of these plants. An alternate or additional object of the present invention is to enable the simplified control of coking with low maintenance, that does not require frequent downtimes or sophisticated regulation systems.

The present invention provides a coking plant of the type including a series of coke ovens, each of which comprising a coking chamber provided with side unloading doors, said chamber being in communication with a riser pipe provided with a coking gas discharge pipe, the discharge pipes of each oven leading into a collection barrel, which is in turn connected to a coking gas treatment circuit, at least one of said discharge pipes of one of said ovens further including means for projecting a pressurized liquid onto the wall of said discharge pipe, said liquid flowing counter-current with respect to the direction of the flow of the gases exiting the chamber.

The plant according to the present invention may further include the following characteristics, taken separately or in combination:

- the projection means of pressurized liquid are composed of a nozzle that projects the liquid in the form of a hollow cone,
- the discharge pipe includes safety means, for example, a safety device, located above the collection barrel and sized in such a way that the pressurized liquid projected with the projection means cannot reach the riser pipe, the liquid projected by the liquid projection means is poured into a tank connected to the barrel, the liquid projecting means being then supplied by the tank connected to a pump, the plant further includes means for measuring oven pressure, for example, a pressure gauge;

the plant further includes means for controlling the pressure of the liquid projection means, for example, a controller, connected to the oven pressure measuring means, the projecting liquid is water-based, the plant includes a sealing plate of the barrel and the liquid projection means are placed above this plate.

The present invention also provides a controlling method of a coking plant according to the invention, wherein the discharge pipe is at least partially closed by activating the means for projecting the pressurized liquid.

In a preferred embodiment, the liquid projection means are activated from the second half of the coking cycle, according to a predetermined scheme.

In another preferred embodiment, the discharge pipe is at least partially closed by activating the means for projecting the pressurized liquid when the pressure into the oven chamber becomes negative, preferably in such a way that the oven pressure is maintained between +5 Pa and +10 Pa until unloading.

BRIEF DESCRIPTION OF THE DRAWINGS

Other characteristics and advantages of the invention will become apparent in the description below, given by way of example and in reference to FIGS. 1 to 3 in which.

DETAILED DESCRIPTION

Figure 1:
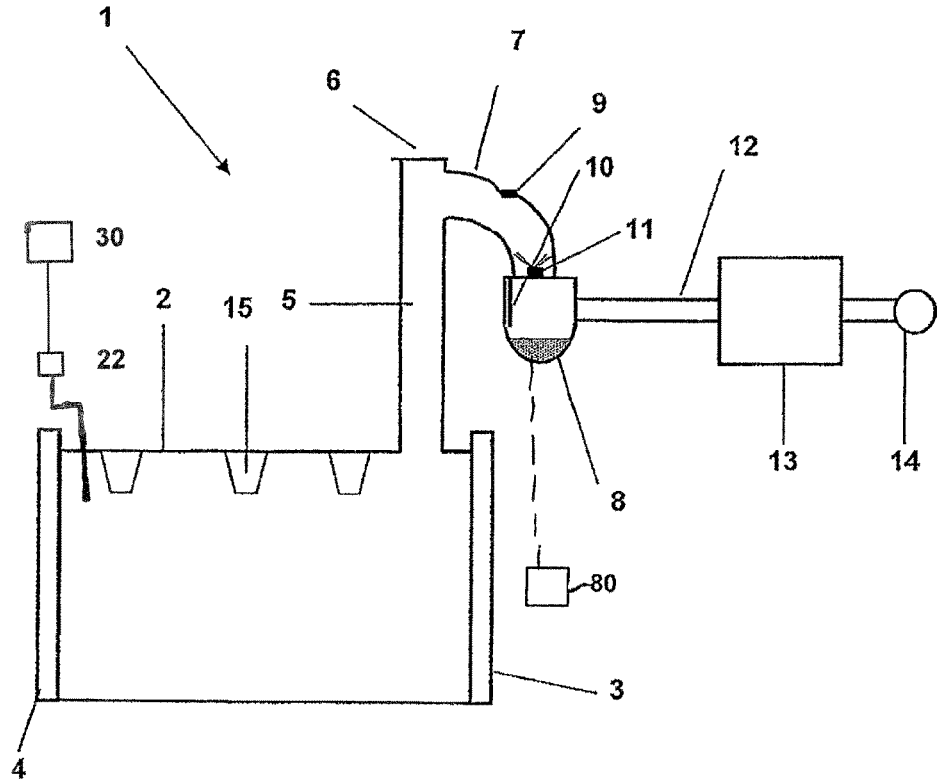
FIG. 1 shows a cross section of a coke oven according to the present invention.

FIG. 1 represents a schematic cross section of a coke ovens battery 1 according to the invention.

It shows first an oven 2 comprising a front door 3 and a rear door 4. The oven chamber 2 communicates with a riser pipe 5 topped with a valve 6. The riser pipe 5 is extended by a lateral bent discharge pipe 7 (called a horse head) which leads into a collection barrel 8 partially filled with water.

The bent discharge pipe 7 is equipped with a conventional nozzle 9 that projects water at low pressure throughout the entire baking period of the load in order to cool the distillation gases and to condense part of the tars in the barrel. This nozzle also allows the projection of water at a high pressure, between 30 and 40 bars, in the direction of flow of the gases out of the oven chamber, thereby creating a suction effect of these gases outside the oven 2. The projected water is usually ammonia water produced in the plant and recycled.

In some plants, for example, an injection of steam at 10-15 bars is used instead of the injection of pressurized ammonia water.

The barrel is provided with a conventional sealing plate 10 that can take an open position as illustrated and can be swiveled to a closed position until it becomes horizontal. In the frame of this invention, a second nozzle 11 is positioned above the connection point of the bent discharge pipe 7 and the barrel 8 and therefore above the sealing plate 10. This nozzle 11 is here supplied in low-pressure water that can go up to 5 bars. Here again, the water used is recycled ammonia water.

Figure 2:
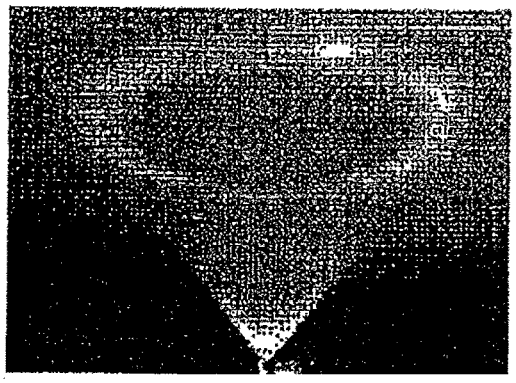
FIG. 2 shows a water curtain in the form of a hollow cone.

In the specific embodiment illustrated in FIG. 1, the nozzle 11 allows creating a water curtain in the form of a hollow cone, of the type represented in FIG. 2. This hollow cone is more or less permeable to the passage of gases from oven 2 towards the barrel 8, and enables to at least partially close the discharge pipe 7. Whatever the pressure of the projected water, it comes into contact with the walls of the discharge pipe 7, the water curtain being more or less permeable to gases depending on the water pressure.

It is, of course, possible to use other types of nozzles that create curtains of another shape, such as, for example, nozzles with side orifices that create a very flared conical curtain that is practically flat.

The nozzle type and the output pressure of the nozzle directed countercurrent 11 depend on the specific configuration of the oven concerned and the person skilled in the art will be able to choose them accordingly. The pressure must in all cases be sufficient to form a thick and regular water curtain that will at least partially block the passage of the gases. It is also essential that the water curtain thus formed is neither projected towards the inside of the oven 2 in order not to damage the refractory bricks nor projected in the flow direction of the gases exiting the chamber to avoid creating a Venturi effect which would be counter-productive by making the negative pressure in the oven worse.

In a preferred embodiment, the bent discharge pipe 7 can be provided with safety means, for example, a safety device, to ensure that the liquid projected from the nozzle 11 can under no circumstances reach the riser pipe 5 and all the more the oven 2, even when the pressure of the nozzle 11 is set to the maximum.

These safety means or device may take any appropriate form and, in particular, may take the form of an extension of the bent discharge pipe 7 with a tubular section that is not bent, positioned right above the barrel 8, which is then shifted downwards. They may also take the form of a lateral flange that partially seals the cross-section of the discharge pipe 7 at the junction between the discharge pipe 7 and the riser pipe 5.

The barrel 8 is then connected to a gas discharge pipe 12 that leads to a gas treatment zone 13, at the end of which the gases are transported up to a gasometer 14 before being reused.

At the beginning of a new coking cycle, the doors 3 and 4 of the oven 2 are closed and fresh coal is loaded by gravity from the top of the oven by means of charging holes 15, the valve 6 being in a closed horizontal position. The plate 10 of the barrel 8 is in the open vertical position. The nozzle 9 is supplied with high pressure during loading and during the few minutes that follow to create negative pressure in the oven and thus capture all loading gases.

At the end of the loading process, the nozzle is no longer supplied with pressurized ammonia water but instead low-pressure ammonia water, in order to cool the gases before they enter the barrel 8. To avoid leakages at the doors during the first hours of baking when the oven pressure is high (several hundred Pa), the pressure inside the barrel 8 is, according to the invention, set at a low positive value of between 40 and 50 Pa. A pressure as low as this in the barrel 8 allows drastically reducing emissions at doors 3 and 4 in the first minutes after loading, or even completely suppressing them.

At the end of the baking process, when the pressure inside the oven 2 becomes negative, the nozzle 11 is then activated by projecting water under low pressure at counter-current to the gases discharged, which enables the oven 2 to be maintained at a positive pressure of 5 to 10 Pa.

This avoids any negative pressure inside the oven 2 which could lead to air entrance from the doors, and eventually deteriorate the oven entrances.

At the time of unloading, the action of the nozzle 11 is interrupted and the plate 10 is brought into the closed horizontal position until the next coking cycle.

The water projected by the nozzle 11 is collected in the barrel 8 with the condensates and the water from the nozzle 9 is then discharged into a collection tank 80, shown schematically, before being treated and recycled.

In the frame of this invention, the ammonia water, already used in the nozzle 9, will be preferably used as the projecting liquid.

The counter-current nozzle 11 according to the invention may be fastened to the bent discharge pipe 7 using any appropriate fasteners.

Figure 3:
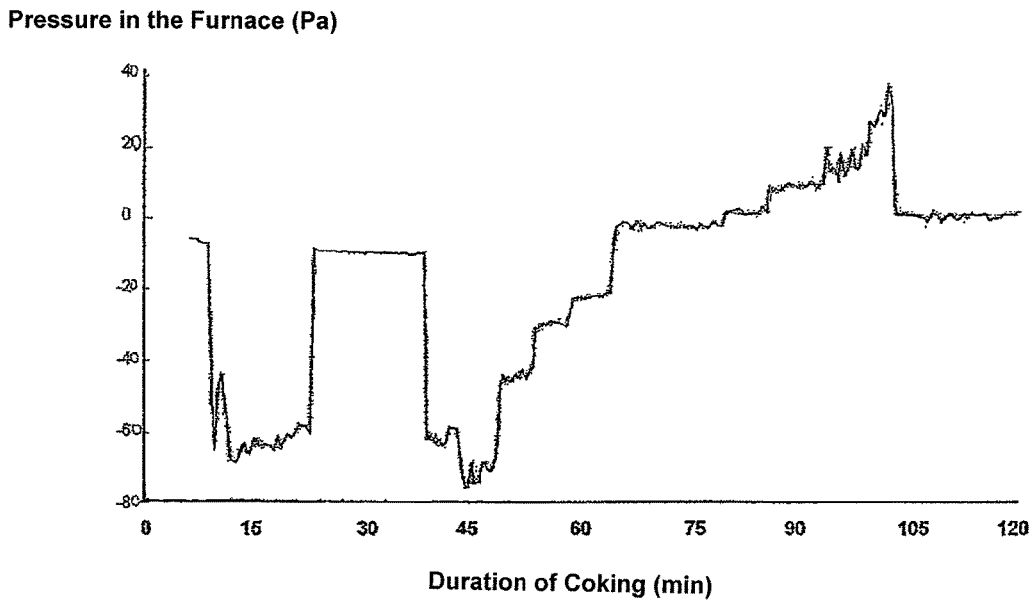
FIG. 3 shows a pressure curve inside the oven over coking time.

Full-scale tests were carried out by implementing the method according to the invention in a coking oven provided with a BEX type counter-current nozzle or equivalent. The tests confirmed that it was possible to precisely regulate the pressure inside the oven, as it can be seen in the chart in FIG. 3, which shows the pressure curve inside the oven depending on the coking time.

In particular, it can be seen that one hour and four minutes after the nozzle 11 is turned on and after various changes in the water pressure, a pressure level of 2 bars at the nozzle outlet (corresponding to 3 bars at the pump level) is necessary and sufficient to reach a slightly positive pressure in the oven, and prevent air from entering the oven through the oven doors.

By adjusting the pressure of the water projected by the counter-current nozzle, the pressure of each coking oven can be finely adjusted.

The use of a counter-current nozzle according to the present invention may be combined with other individual regulation means of coking ovens, while remaining within the scope of this invention.

To automate the process according to the present invention, it is sufficient to continuously measure the pressure inside each concerned oven, with a means for measuring pressure connected thereto, for example, a pressure gauge 22 and to send the information to a process management computer, for example, a controller 30, that will set off the nozzles 11 depending on the pressure level measured. In another time, when the pressure of the oven 2 is going to reduce further at the same time as the conversion of coal into coke is completed, all that will need to be done is to increase the pressure of the projected water to maintain the pressure of the concerned oven within the desired pressure range.

When it is not desired to continuously measure the pressure of the oven, it could also be envisaged to simply provide the ovens with devices that notify the crossing of a pressure threshold, which could then trigger the sealing means of the bent discharge pipe 7.

It is also possible not to measure the pressure in the ovens battery but to determine beforehand the pressures of a usual coking cycle and adjust the nozzle control equipment 11 so that they project the liquid at a predetermined time with a defined pressure, which could change according to a predetermined scheme. The projection of the liquid thus can begin when the last quarter of the coking cycle is reached, for example.

It is also possible to control the system by an operator who may collect the information transmitted by the process management computer if necessary.

The invention claimed is:

1. A coking plant comprising:

a series of coke ovens, each oven including a coking chamber provided with side unloading doors, a riser pipe in communication with the coking chamber and a coking gas discharge pipe connected to the riser pipe, the discharge pipe including safety means;

a collection barrel, the discharge pipes of each oven leading into the collection barrel the safety means being located above the collection barrel;

a coking gas treatment circuit connected to the collection barrel;

a projection means for projecting pressurized liquid onto a wall of one of the discharge pipes, counter-current with respect to a direction of a flow of gas exiting the respective coking chamber, the safety means sized in such a way that the pressurized liquid projected by the projection means cannot reach the riser pipe;

a means for measuring the pressure of one of the ovens;

and a means for controlling the pressure of the projection means, connected to the means for measuring pressure;

Wherein the means for controlling the pressure of the liquid projection means is configured to activate the projection means when the means for measuring pressure detects a negative pressure within the coke oven, such that the activated projection means maintains the pressure of the oven at a desired level.

2. The coking plant as recited in claim 1, wherein the projection means include a nozzle that projects the liquid in a form of a hollow cone.

3. The coking plant according to claim 1, further comprising a tank connected to the collection barrel, the liquid projected by the projection means being poured into the tank, the liquid projection means being then supplied by the tank connected to a pump.

4. The coking plant according to claim 1, wherein the liquid is water-based.

5. A method for controlling a coking plant according to claim 1, wherein the discharge pipe is at least partially closed by activating the pressurized liquid projection means.

6. The method according to claim 5, wherein the pressurized liquid projection means are activated during a second half of the coking cycle, according to a predetermined scheme.

7. The method according to claim 5, wherein the discharge pipe is at least partially closed by activating the pressurized liquid projection means when a pressure inside the chamber of the oven becomes negative.

8. The method according to claim 7, wherein the pressurized liquid projection means are activated in such a way that the pressure of the oven is maintained between +5 Pa and +10 Pa until coke is unloaded.

9. The coking plant as recited in claim 1, wherein the projection means is positioned above the connection between the discharge pipe and collection barrel.

10. The coking plant as recited in claim 1, wherein the collection barrel includes a sealing plate which can be moved upward from an open position in which the collection barrel is open to the discharge pipe to a closed position in which the collection barrel is closed to the discharge pipe.

11. The coking plant as recited in claim 10, wherein the projection means is positioned above the sealing plate.

12. The coking plant according to claim 1, further comprising a second projection means projecting liquid in the direction of flow of gas exiting the coking chamber.

13. A coking plant comprising:

a series of coke ovens, each coke oven including a coking chamber provided with side unloading doors, a riser pipe connected the coking chamber, and a coking gas discharge pipe connected to the riser piper, the discharge pipe including a safety device;

at least one collection barrel, the discharge pipe of each oven leading into the at least one collection barrel, the safety device being located above the collection barrel;

a coking gas treatment circuit connected to the at least one collection barrel;

at least one of the coke ovens including a nozzle, the nozzle projecting pressurized liquid onto a wall of the discharge pipe counter-current with respect to a direction of a flow of gas exiting the coking chamber, the safety device being sized so the pressurized liquid projected by the nozzle cannot reach the riser pipe;

a pressure gauge for measuring the pressure of one of the ovens;

and a controller connected to the pressure gauge, the controller configured to control a pressure of the nozzle;

Wherein the controller is configured to activate the nozzle when the pressure gauge detects a negative pressure within the oven, such that the activated nozzle maintains the pressure of the oven at a desired level.

14. The coking plant according to claim 13, wherein the nozzle projects the liquid in a form of a hollow cone.

15. The coking plant according to claim 13, further comprising a tank connected to the at least one collection barrel, the liquid projected by the nozzle being poured into the tank, the nozzle being supplied by the tank via a pump.

16. The coking plant according to claim 13, wherein the liquid is water-based.

17. A method for controlling a coking plant according to claim 13, the method comprising the step of:

closing, at least partially, the discharge pipe by activating the nozzle.

18. The method according to claim 17, wherein the nozzle is activated during a second half of a coking cycle, according to a predetermined scheme.

19. The method according to claim 17, wherein the step of closing the discharge pipe occurs when a pressure inside the chamber of the oven becomes negative.

20. The method according to claim 19, wherein the nozzle is activated in such a way that the pressure in the oven is maintained between +5 Pa and +10 Pa until coke is unloaded.

21. The method according to claim 19, further comprising the step of:

maintaining the pressure in the oven between +5 Pa and +10 Pa until coke is unloaded.

22. The coking plant as recited in claim 13, wherein the nozzle is positioned above the connection between the discharge pipe and collection barrel.

23. The coking plant as recited in claim 13, wherein the collection barrel includes a sealing plate which can be moved upward from an open position in which the collection barrel is open to the discharge pipe to a closed position in which the collection barrel is closed to the discharge pipe.

24. The coking plant as recited in claim 23, wherein the nozzle is positioned above the sealing plate.

25. The coking plant as recited in claim 13, further comprising a second nozzle projecting liquid in the direction of flow of gas exiting the coking chamber.

* * * * *